US006272308B1

(12) United States Patent
Maeda et al.

(10) Patent No.: US 6,272,308 B1
(45) Date of Patent: Aug. 7, 2001

(54) ROLLER-SHAPED HEATER AND FUSING UNIT USING A ROLLER-SHAPED HEATER

(75) Inventors: Tomohiro Maeda, Yamatokoriyama; Toshiaki Kagawa, Sakurai, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/558,642

(22) Filed: Apr. 26, 2000

(30) Foreign Application Priority Data

May 26, 1999 (JP) ..... 11-146138

(51) Int. Cl.[7] ..... G03G 15/20

(52) U.S. Cl. ..... 399/328; 219/216; 399/67; 399/333

(58) Field of Search ..... 399/330, 333, 399/328, 335, 67, 69, 88, 90; 219/216, 469, 470, 476, 480; 492/46; 118/60; 432/60, 228; 430/99, 124

(56) References Cited

U.S. PATENT DOCUMENTS

| | | | | |
|---|---|---|---|---|
| 4,628,183 | * | 12/1986 | Satomura | 219/216 |
| 4,724,303 | * | 2/1988 | Martin et al. | 219/216 |
| 5,729,814 | * | 3/1998 | Suzuki et al. | 399/333 |
| 6,137,087 | * | 10/2000 | Tomatsu | 219/216 |

FOREIGN PATENT DOCUMENTS

| | | | |
|---|---|---|---|
| 05-035137 | * | 2/1993 | (JP) . |
| 08-111279 | * | 4/1996 | (JP) . |
| 08-179645 | * | 7/1996 | (JP) . |
| 8220915 | | 8/1996 | (JP) . |
| 08-262912 | * | 10/1996 | (JP) . |
| 09-197876 | * | 7/1997 | (JP) . |
| 11-194634 | * | 7/1999 | (JP) . |

* cited by examiner

*Primary Examiner*—Sophia S. Chen
(74) *Attorney, Agent, or Firm*—Renner, Otto, Boisselle & Sklar

(57) ABSTRACT

A roller-shaped heater includes: a cylindrically formed roller member; and a heat generator disposed on the inner peripheral surface of the roller member and composed of a heat-resisting insulation material and resistance heating elements formed on the heat-resisting insulation material, and is constructed in such a manner that the heat generator is composed of a multiple number of separated portions extending in the axial direction of the cylinder of the roller member and each portion has the resistance heating element. Alternatively, the roller-shaped heater is constructed in such a manner that the heat generator is formed with a multiple number of resistance heating elements and the multiple number of resistance heating elements are arranged in parallel with each other in the axial direction of the cylinder of the roller member.

24 Claims, 6 Drawing Sheets

ROLLER-SHAPED HEATER AND FUSING UNIT USING A ROLLER-SHAPED HEATER

BACKGROUND OF THE INVENTION (1) Field of the Invention

The present invention relates to a roller-shaped heater which is composed of resistance heating elements in a sheet-like form and is arranged in close contact with a roller (e.g., the inner peripheral surface of the roller) and a fusing unit using the roller-shaped heater.

(2) Description of the Prior Art

In image forming apparatus using electrophotography, a photoreceptor is charged uniformly, then is illuminated by an exposure light source such as a laser beam etc., in accordance with image information so as to form a static latent image on the photoreceptor. Next, the static latent image on the photoreceptor is developed with a developer into a visual image. The developed image is then transferred to a recording medium such as recording paper etc., through a transfer station. Then the image on the recording paper is fused and fused by a fusing unit.

The fusing unit includes, for example, a pair of rollers opposing to each other, i.e., a heat roller and a pressure roller. The toner image on the recording paper is fed and pressed with heat between the two rollers onto the recording paper. The heat roller is composed of, for example, a cylindrical metallic core made up of aluminum etc., and a separation layer of a fluororesin coated on the outer peripheral surface of the metal core. The metal core generally incorporates a halogen lamp as a heater. When electric power is supplied to this halogen lamp, it generates heat and the heat makes the entire heat roller hot.

However, because there is an air layer between the halogen lamp and the metal core, the conventional heat roller using a halogen lamp has suffered a drawback in that the efficiency of heat transport to the heat roller is poor and hence the heat roller takes time until it is heated to a required temperature level.

In order to solve this problem, there is a proposed method in which a resistance heater which itself heats is arranged on the inner peripheral surface of a heat roller so that the heat roller will be heated directly with no air layer in between. A heat roller of this type is disclosed in Japanese Patent Application Laid-Open Hei 8 No.220915. In Japanese Patent Application Laid-Open Hei 8 No.220915, a resistance heating element having a predetermined pattern is formed on an insulation sheet. This is referred to as a heat generator (heat generating sheet). The heat generator (heat generating sheet) is inserted into the heat roller interior with the resistance heating element oriented toward the central axis of the heat roller. The resistance heating element has a pair of electric power supply strips disposed at both ends of the roller body and extending in the peripheral direction of the roller body and the power supply portions electrically connected to the resistance heating element is bonded, thus constituting the heat generator (heat generating sheet). A pair of electrodes are placed in frictional contact with these electric power supply portions so as to supply electric power to the resistance heating element via the power supply portions. Thus, the resistance heating element is supplied with power to heat itself and hence heat the entire roller.

In the case of using a resistance heating element of the above type, setting of a heat generator (heat generating sheet) inside the heat roller becomes difficult as the roller diameter becomes smaller. Further, in this method, when the resistance heating element on the heat generator (heat generating sheet) is supplied with electric power, the entire sheet is heated. Since heating only in the nip area is effective enough to fuse the recording medium such as recording paper etc., heating the entire heat roller is wasteful and consumes more electric power compared to a which the roller is heated only around the nip area.

SUMMARY OF THE INVENTION

The present invention has been devised in order to solve the above problem and it is therefore an object of the present invention to provide a roller-shaped heater of which the heat generator can be readily set in close contact with the roller interior even the roller is small in diameter as well as providing a fusing unit using such a roller-shaped heater.

It is another object of the present invention to provide a roller-shaped heater which can be heated partially by supplying electric power to a necessary portion only as well as providing a fusing unit using such a roller-shaped heater.

In order to achieve the above object, the present invention is configured as follows:

In accordance with the first aspect of the present invention, a roller-shaped heater includes:

a cylindrically formed roller member; and a heat generator composed of a heat-resisting insulation material and resistance heating elements formed on the heat-resisting insulation material, and is characterized in that the heat generator is composed of a multiple number of separated portions extending in the axial direction of the cylinder of the roller member and each portion has the resistance heating element.

In accordance with the second aspect of the present invention, a roller-shaped heater includes:

a cylindrically formed roller member; and a heat generator composed of a heat-resisting insulation material and resistance heating elements formed on the heat-resisting insulation material, and is characterized in that the heat generator is formed with a multiple number of resistance heating elements and the multiple number of resistance heating elements are arranged in parallel with each other in the axial direction of the cylinder of the roller member.

In accordance with the third aspect of the present invention, the roller-shaped heater having the above first feature is characterized in that power receiving portions that receive electric power for the resistance heating elements formed in the heat generator are formed at one end of the heat generator.

In accordance with the fourth aspect of the present invention, the roller-shaped heater having the above second feature is characterized in that power receiving portions that receive electric power for the resistance heating elements formed in the heat generator are formed at one end of the heat generator.

In accordance with the fifth aspect of the present invention, a fusing unit includes:

a roller-shaped heater comprising: a cylindrically formed roller member; and a heat generator composed of a heat-resisting insulation material and resistance heating elements formed on the heat-resisting insulation material wherein the heat generator is composed of a multiple number of separated portions extending in the axial direction of the cylinder of the roller member and each portion has the resistance heating element; and a pressing member disposed abutting against the roller-shaped heater, and is characterized in that fusing is performed by conveying a recording medium having an unfused toner image supported thereon through the nip between the roller-shaped heater and the pressing member.

In accordance with the sixth aspect of the present invention, a fusing unit includes:

a roller-shaped heater comprising: a cylindrically formed roller member; and a heat generator composed of a heat-resisting insulation material and resistance heating elements formed on the heat-resisting insulation material wherein the heat generator is provided with a multiple number of resistance heating elements extending in parallel with each other in the axial direction of the cylinder of the roller member; and a pressing member disposed abutting against the roller-shaped heater, and is characterized in that fusing is performed by conveying a recording medium having an unfused toner image supported thereon through the nip between the roller-shaped heater and the pressing member.

In accordance with the seventh aspect of the present invention, the fusing unit having the above fifth feature is characterized in that the roller-shaped heater has a power receiving portion at one end of the heat generator through which electric current is supplied to the resistance heating elements formed in the heat generator and the pressing member is disposed abutting against the roller-shaped heater, so that fusing is performed by conveying a recording medium having an unfused toner image supported thereon through the nip between the roller-shaped heater and the pressing member.

In accordance with the eighth aspect of the present invention, the fusing unit having the above sixth feature is characterized in that the roller-shaped heater has a power receiving portion at one end of the heat generator through which electric current is supplied to the resistance heating elements formed in the heat generator and the pressing member is disposed abutting against the roller-shaped heater, so that fusing is performed by conveying a recording medium having an unfused toner image supported thereon through the nip between the roller-shaped heater and the pressing member.

In accordance with the ninth aspect of the present invention, the fusing unit having the above fifth feature is characterized in that electric power is selectively supplied to one of the resistance heating elements in the heat generator which corresponds to the nip area formed between the roller-shaped heater and the pressing member.

In accordance with the tenth aspect of the present invention, the fusing unit having the above sixth feature is characterized in that electric power is selectively supplied to one of the resistance heating elements in the heat generator which corresponds to the nip area formed between the roller-shaped heater and the pressing member.

In accordance with the eleventh aspect of the present invention, the fusing unit having the above seventh feature is characterized in that electric power is selectively supplied to one of the resistance heating elements in the heat generator which corresponds to the nip area formed between the roller-shaped heater and the pressing member.

In accordance with the twelfth aspect of the present invention, the fusing unit having the above eighth feature is characterized in that electric power is selectively supplied to one of the resistance heating elements in the heat generator which corresponds to the nip area formed between the roller-shaped heater and the pressing member.

In accordance with the thirteenth aspect of the present invention, the fusing unit having the above fifth feature is characterized in that electric power can be supplied to all the resistance heating elements in the heat generator so that the entire roller-shaped heater is heated and also electric power can be selectively supplied to one of the resistance heating elements in the heat generator which corresponds to the nip area formed between the roller-shaped heater and the pressing member.

In accordance with the fourteenth aspect of the present invention, the fusing unit having the above sixth feature is characterized in that electric power can be supplied to all the resistance heating elements in the heat generator so that the entire roller-shaped heater is heated and also electric power can be selectively supplied to one of the resistance heating elements in the heat generator which corresponds to the nip area formed between the roller-shaped heater and the pressing member.

In accordance with the fifteenth aspect of the present invention, the fusing unit having the above seventh feature is characterized in that electric power can be supplied to all the resistance heating elements in the heat generator so that the entire roller-shaped heater is heated and also electric power can be selectively supplied to one of the resistance heating elements in the heat generator which corresponds to the nip area formed between the roller-shaped heater and the pressing member.

In accordance with the sixteenth aspect of the present invention, the fusing unit having the above eighth feature is characterized in that electric power can be supplied to all the resistance heating elements in the heat generator so that the entire roller-shaped heater is heated and also electric power can be selectively supplied to one of the resistance heating elements in the heat generator which corresponds to the nip area formed between the roller-shaped heater and the pressing member.

In accordance with the seventeenth aspect of the present invention, the fusing unit having the above ninth feature, further comprises: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

In accordance with the eighteenth aspect of the present invention, the fusing unit having the above tenth feature, further comprises: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

In accordance with the nineteenth aspect of the present invention, the fusing unit having the above eleventh feature, further comprises: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

In accordance with the twentieth aspect of the present invention, the fusing unit having the above twelfth feature, further comprises: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

In accordance with the twenty-first aspect of the present invention, the fusing unit having the above thirteenth feature, further comprises: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

In accordance with the twenty-second aspect of the present invention, the fusing unit having the above fourteenth feature, further comprises: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

In accordance with the twenty-third aspect of the present invention, the fusing unit having the above fifteenth feature, further comprises: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

In accordance with the twenty-fourth aspect of the present invention, the fusing unit having the above sixteenth feature, further comprises: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

According to the present invention, a heat generator made up of a heat-resisting insulation material is separated into a multiple number of portions of heat generator, and each portion is formed with a resistance heating element arranged in a predetermined pattern on the heat-resisting insulation material. The thus configured heat generator portions are inserted into the roller interior so that they are arranged in parallel to each other, side by side, with respect to the peripheral direction of the roller. Therefore, it is possible to provide a roller-shaped heater of which the heat generator is easily set in close contact even if the roller is small in diameter.

According to the present invention, by providing a multiple number of resistance heating elements extending in parallel to each other on a single sheet of heat generator, it is possible to provide a roller-shaped heater capable of supplying the necessary portion with electric power to heat the selected portion locally.

According to the present invention, a heat generator made up of a heat-resisting insulation material is separated into a multiple number portions of heat generator, and each portion is formed with a resistance heating element arranged in a predetermined pattern on the heat-resisting insulation material. The thus configured heat generator portions are inserted into the roller interior so that they are arranged in parallel to each other, side by side, with respect to the peripheral direction of the roller. Therefore, it is possible to provide a fusing unit using a roller-shaped heater of which the heat generator is easily set in close contact even if the roller is small in diameter.

According to the present invention, by providing a multiple number of resistance heating elements extending in parallel to each other on a single sheet of heat generator, it is possible to provide fusing unit using a roller-shaped heater which is capable of supplying the necessary portion with electric power to heat the selected portion locally.

BRIEF DESCRIPTION OF THE DRAWINGS

FIG. 6A showing an arrangement of power supply and power receiving portions, FIG. 6B showing a section of the power receiving portion taken along a plane 101–102, FIG. 6C showing a configuration of a power supply portion, FIG. 6D showing another configuration of a power supply portion; and, FIGS. 7A to 7D are diagrams showing the method of supplying electric power to a roller-shaped heater of another type of the present invention.

DESCRIPTION OF THE PREFERRED EMBODIMENTS

Now, a roller-shaped heater and a fusing unit using the roller-shaped heater in accordance with one embodiment of the present invention will be described with reference to the accompanying drawings. In the description of the embodiment of the present invention, the fusing unit is applied to a monochrome laser printer as an electrophotographic apparatus.

Figure 1:
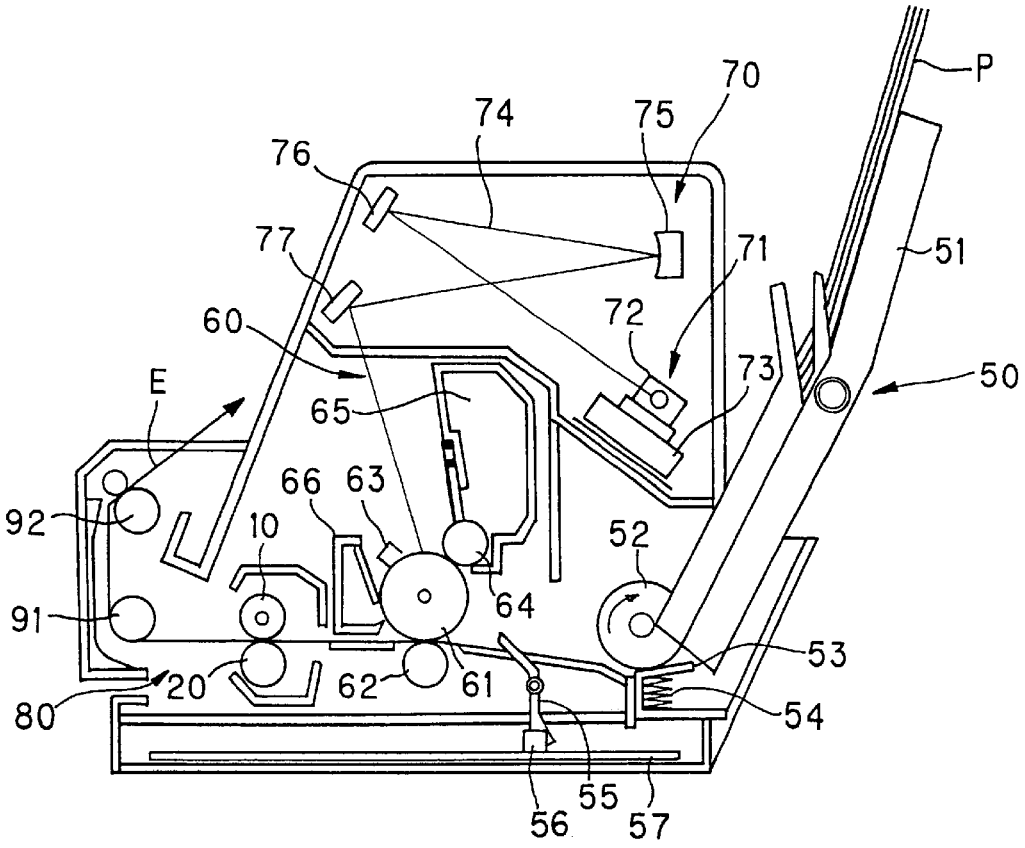
FIG. 1 is a schematic sectional view showing a printer as an example to which a fusing unit of the present invention is applied.

FIG. 1 is a view showing a configuration of a laser printer according to the present embodiment. This laser printer includes a paper feed portion 50, an image forming unit 60, a laser scanning portion 70, a fusing unit 80. In the laser printer of this configuration, paper P is conveyed from paper feed portion 50 to image forming unit 60. In this image forming unit 60, a toner image is formed based on exposure of a laser beam 74 from laser scanning portion 70. The toner image is transferred to paper P as it is being conveyed.

The paper P, the recording medium, having a toner image transferred thereon, is conveyed to a fusing unit 80, where the toner image is fused to paper P. Finally, the toner image fused on paper P is discharged to the outside of the machine by means of paper conveyance rollers 91 and 92 arranged downstream of fusing unit 80 with respect to the paper conveyance direction. That is, paper P is conveyed along the path shown by an arrow E in the drawing, passing through a paper feed tray 51, image forming unit 60 and fusing unit 80, in this order and is discharged to the outside of the machine. The aforementioned paper feed portion 50 includes: paper feed tray 51, a paper feed roller 52, a paper separating friction plate 53, a pressing spring 54, a paper detection actuator 55, a paper detection sensor 56 and a control circuit 57.

In response to a print command, paper P set in paper feed tray 51 is fed, sheet by sheet, by the functions of paper feed roller 52, paper separating friction plate 53 and pressing spring 54, into the printer interior. Paper P thus fed turns over paper detection actuator 55, whereby paper detection optical sensor 56 outputs an electric signal to instruct the start of image printing. Control circuit 57 activated by the operation of paper detecting actuator 55 sends an image signal to a laser diode light emitting unit 71 of laser scanning portion 70 so as to control activation and deactivation of the laser diode.

The aforementioned laser scanning portion 70 includes the laser diode light emitting unit 71, a scanning mirror 72, a scanning mirror motor 73, reflection mirrors 75, 76 and 77. Scanning mirror 72 is rotated at a constant, high speed by scanning mirror motor 73. Illustratively, in FIG. 1, a laser beam 74 is deflected in the direction perpendicular to the document surface. Laser beam 74 emitted from laser diode light emitting unit 71 passes through reflection mirror 76, 75, 77 to illuminate an aftermentioned photoreceptor 61. During exposure, laser beam 74 selectively illuminates the surface of photoreceptor 61, based on the information of activation and deactivation from the aforementioned control circuit 57. Image forming unit 60 includes a photoreceptor 61, a transfer roller 62, a charging member 63, a developing roller 64, a developing unit 65 and a cleaning unit 66.

Exposure of the photoreceptor having been charged by charging member 63 to laser beam 74 selectively releases the surface charge on the photoreceptor, forming a static latent image. The toner used for development is stored in developing unit 65. The toner which has been charged by appropriate agitation inside developing unit 65 will adhere to the developer roller 64 surface so that the toner can produce a toner image on photoreceptor 61 by the actions of the electric field created by the developing bias voltage applied to developing roller 64 and the photoreceptor surface potential. Paper P conveyed from paper feed portion 50 is nipped between photoreceptor 61 and transfer roller 62 and conveyed thereby.

The toner on photoreceptor 61 is electrically attracted to paper P and transferred thereto by the action of the electric field generated by the transfer voltage applied to transfer roller 62. During transfer, the toner on photoreceptor 61 is caused to transfer to paper P by transfer roller 62 while the untransferred toner is collected by cleaning unit 66.

Then, paper P is conveyed to fusing unit 80, where the paper with the toner is pressed at an appropriate temperature between a pressure roller 20 and a heat roller 10 which is kept a predetermined temperature. The toner fuses and is fused to paper P forming a stable image. Paper P then is conveyed and discharged to the outside by means of paper conveyance rollers 91 and 92.

Figure 2:
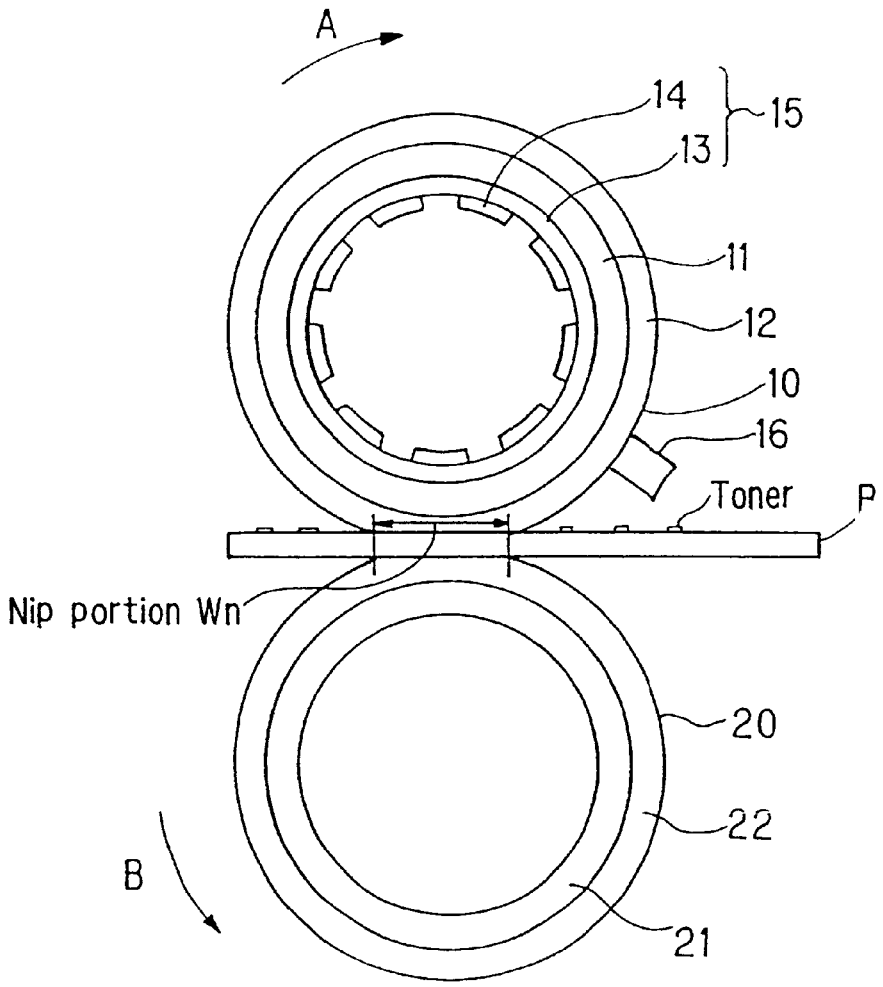
FIG. 2 is a schematic sectional view showing a fusing unit of the present invention.

Referring next to FIG. 2, description will be made of heat roller 80. The fusing unit has heat roller 10 having a roller-shaped heater and a pressure roller 20 opposing thereto while an elastic member such as a spring etc. is arranged so that the rollers come in contact to each other with a predetermined pressure. A nip portion Wn in FIG. 2 is created by the pressing contact between heat roller 10 and pressure roller 20. Heat roller 10 is rotated in the direction of an arrow A by means of an unillustrated driving means. Pressure roller 20 is driven following the rotation of the heat roller in the direction of another arrow B.

Pressure roller 20 has an outside diameter $\phi$ of 25 mm, for example, and is composed of a metal core 21 of stainless steel ($\phi$22 mm) and a separation layer 22 made up of LTV (low temperature vulcanizing) silicone rubber layer (of 1.5 mm thick) formed on the metal core.

Heat roller 10 has an outside diameter $\phi$ of 20 mm, for example, and is composed of a hollow metal core 11 of aluminum and a coating layer 12 made up of tetrafluoroethylene (PTFE) formed on the metal core. Inserted inside hollow metal core 11 is a heating member, i.e., a heat generator (heat generating sheet) 15 made up of resistance heating element 14 formed in a heat-resisting insulation material 13. When this heat generator 15 is supplied with electric power through outer electrodes, resistance heating element 14 generates heat so that heat roller 10 is heated and set at a predetermined temperature.

A temperature detecting means 16 (e.g., thermistor) for detecting the surface temperature of heat roller 10 is arranged upstream with respect to the rotational direction of heat roller 10, in the vicinity of the entrance of nip portion Wn. The detection signal from temperature detecting means 16 is sent to an unillustrated power supply control circuit, whereby the power supply to heat roller 10 is controlled based on the detection signal.

The material of metal core 11 of heat roller 10 is not limited to aluminum, but carbon steel, glass, ceramics, high heat-resisting resin, etc., can be used. Heat generator (heat generating sheet) 15 provided inside heat roller 10 can be formed by providing a resistor such as stainless steel on a sheet-like, heat-resisting insulation material such as polyimide, for example, then forming a predetermined pattern by etching or other techniques.

In the first configuration of the present invention, the heat generator is composed of a multiple number of separated portions of heat generator. In the second configuration of the present invention, separated resistance heating elements are arranged in a single heat generator. These heat generators will be described in detail later.

As the heat-resisting insulation material, any insulating material having heat resistance can be used other than polyimide. As the resistance heating element, any material such as copper etc. may be used as long as it can be used as resistance heating element.

The thus formed heat generator 15 is inserted into the interior of metal core 11 of the roller in such a manner that, for example, resistance heating elements 14 are oriented toward the central axis and heat generator 15 comes in close contact with metal core 11, thus forming a roller-shaped heater. Here, heat resistance insulation material 13 functions to provide insulation between metal core 11 and resistance heating element 14. In the above, heat generator 15 is provided on the inner side of metal core 11 but it can be provided on the inner side and/or outer peripheral surface of metal core 11.

For close contact, a heat-resisting adhesive (e.g., silicone grease) can be applied between metal core 11 and heat-resisting insulation member. If the heat generator is fused with an adhesive, the heat generator cannot be replaced when it is damaged, so that the heat generator may be set into close contact with a adhesive-free means, such as a fastener member (for example, an insulating material such as rubber or the like may be inserted into the metal core interior so as to press the heat generating sheet outwardly, as disclosed in Japanese Patent Application Laid-Open Hei 9 No. 138605).

Next, the heat generator and a roller-shaped heater 41 using the heat generator of the present invention will be described. In each portion of heat generator 15, resistance heating element 14 is formed on heat-resisting insulation material 13 as shown in FIG. 3C in a predetermined pattern.

Figure 3A:
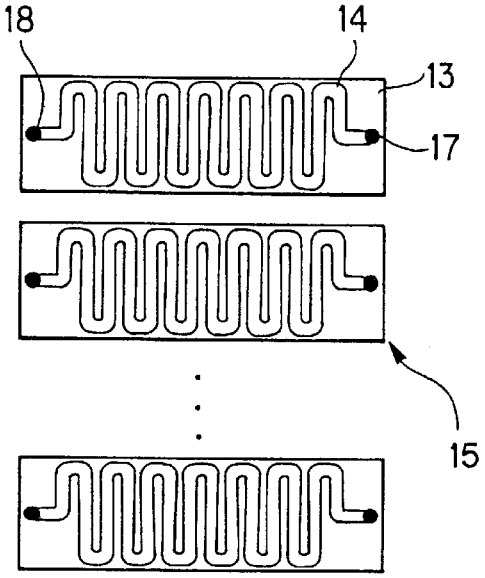
FIGS. 3A to 3C are views showing a configuration of a roller-shaped heater having a heat generator of the present invention, FIG. 3A showing the development of the heat generator, FIG. 3B showing the heat generator inserted inside the roller-shaped heater, FIG. 3C showing a structure of the heat generator.
Figure 3B:
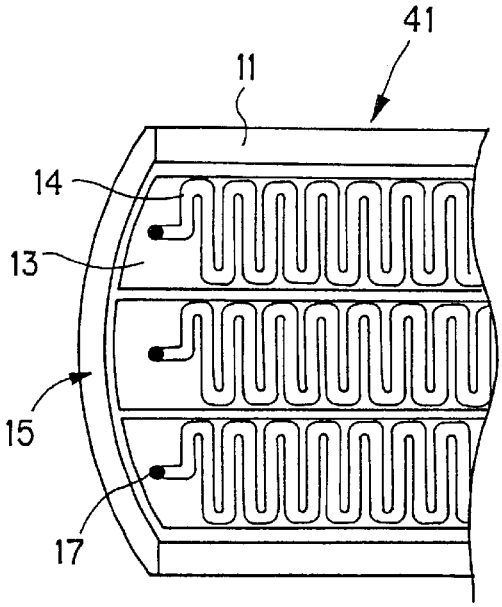
Figure 3C:
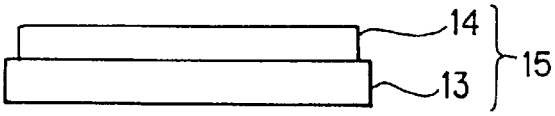

The heat generator of the present invention is composed of a multiple number of rectangular, heat generator (heat generating sheets) 15 as shown in FIG. 3A. Each portion of heat generator 15 has a resistance heating element 14 of a repeatedly cranked pattern. Formed at both ends of resistance heating element 14 are terminals 17 and 18 which are connected to the power receiving portions in contact with the power supply portions.

Figure 5A:
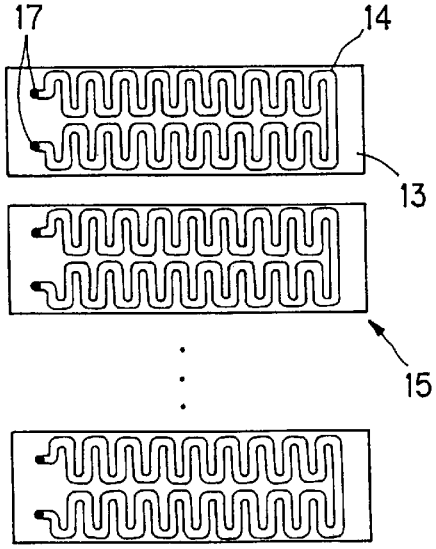
FIGS. 5A and 5B are still another configuration of a heat generator of the present invention.
Figure 5B:
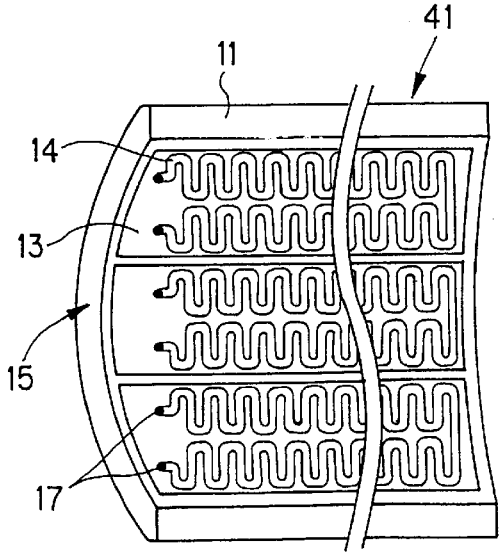

As another pattern, the terminals may be arranged on only one side of heat generator 15 as shown in FIG. 5A (terminals 17). For this heat generator 15, power can be supplied from one side. The pattern of resistance heating element 14 should not be limited to the repeatedly cranked patterns but any pattern may be used as long as it can uniformly heat roller-shaped heater 41. These multiple number of portions of heat generator are inserted into the roller interior with both ends of resistance heating elements 14 aligned with the axial direction of the roller (the roller-shaped metal core) and the faces of resistance heating elements 14 oriented toward the roller's center.

The arrangement of multiple heat generators over the entire inner peripheral surface of the roller as above provides easiness as compared to the conventional method of the arrangement in which a single heat generator needs to be arranged over the entire peripheral surface of the roller.

Particularly, this configuration is effective for small-diametric rollers. Further, if the heat generator is partially damaged, it has been impossible conventionally to partially replace the heat generator inside the roller. However, because the present embodiment uses a multiple number of portions of heat generator, this configuration permits the damaged heat generator alone to be replaced, becoming more economical. The multiple heat generators can be fused inside the roller by the above-described method.

Figure 4A:
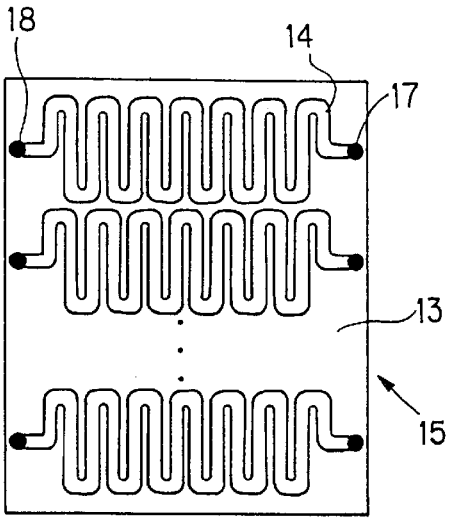
FIGS. 4A and 4B are another configuration of a heat generator of the present invention.
Figure 4B:
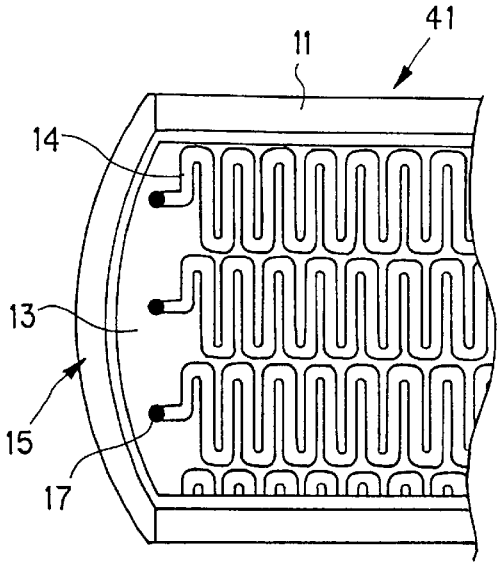

Since when the roller has a relatively large diameter, a single heat generator can be set relatively easily over the entire inner peripheral surface of the metal core, a single sheet of heat generator 15 having a multiple number of resistance heating elements 14 may be formed as shown in FIG. 4A. In this heat generator 15, a multiple number of resistance heating elements 14 are arranged in having a predetermined pattern in parallel to each other with terminals 17 and 18 disposed at both ends thereof as shown in FIG. 3A. The heat generator is arranged inside the metal core in the same manner as above so that both ends of resistance heating elements 14 are aligned with the axial direction of the roller (the roller-shaped metal core) and the faces of resistance heating elements 14 are oriented toward the roller's center (FIG. 4B).

Figure 6A:
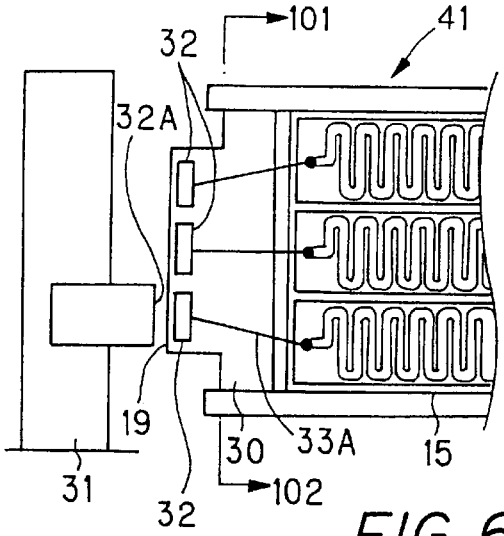
FIGS. 6A to 6D are diagrams showing the method of supplying electric power to a roller-shaped heater of the present invention.

Next, description will be made of how to supply electric power to heat generator 15 incorporated in the roller. FIG. 6A is a view showing a configuration where electric power is supplied to multiple portions of heat generator 15 as the portion arranged in parallel to each other inside heat roller 10 (roller-shaped heater 41). Here, since the arrangements of terminals 17 of resistance heating elements 14 in heat roller 10 (roller-shaped heater 41) are the same at both ends, the figure only shows the arrangement on the left side.

Figure 6B:
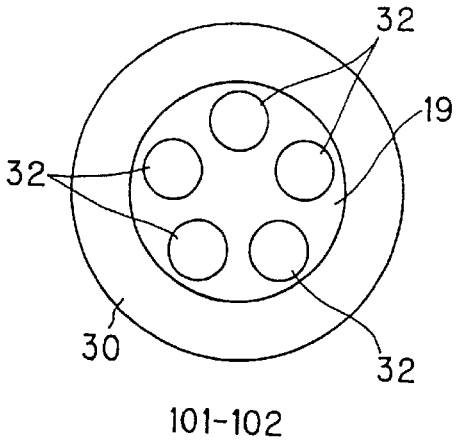

Provided at both ends inside metal core 11 are intermediary members 30 made up of an electric insulator. This intermediary member 30 has a power receiving portion 19. In order to supply electric power to each portion of heat generator 15, this power receiving portion 19 has a multiple number of electrodes 32 which will come into contact with a power supply portion 32A provided for a supporter 31. Electrodes 32 are arranged on a circle concentric to the central axis of heat roller 10 as shown in FIG. 6B. Each resistance heating element 14 of heat generator 15 fused inside metal core 11 is connected to the associated electrode 32 of power receiving portion 19 via a lead wire 33A.

Figure 6C:
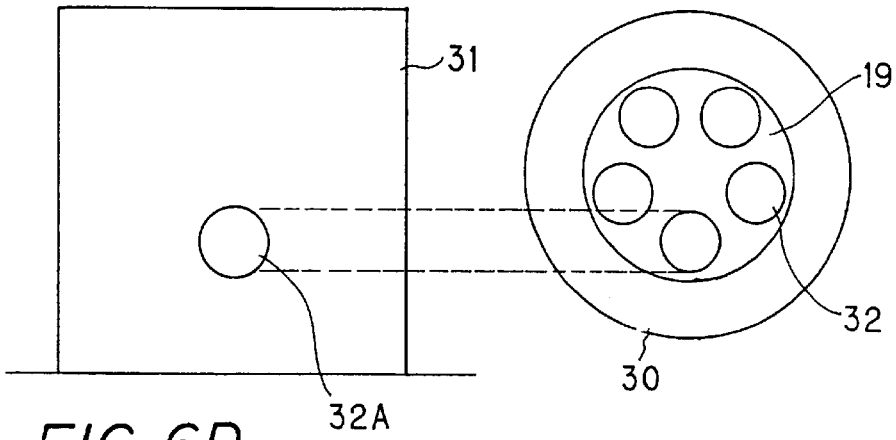

Next, the configuration of power supply portion 32A will be described. As shown in FIG. 6C, power supply portion 32A is set off the central axis of heat roller 10 downwards in the figure and is formed slightly greater in size than electrode 32 provided for power receiving portion 19. This manipulation can relax the positioning precision for contact between power supply portion 32A and electrode 32 of power receiving portion 19. Thus, by forming power supply portion 32A and power receiving portion 19 in almost the same shape and size, it is possible to supply electric power to the heat generator 15 which is positioned near the nip portion Wn of heat roller 10.

Figure 6D:
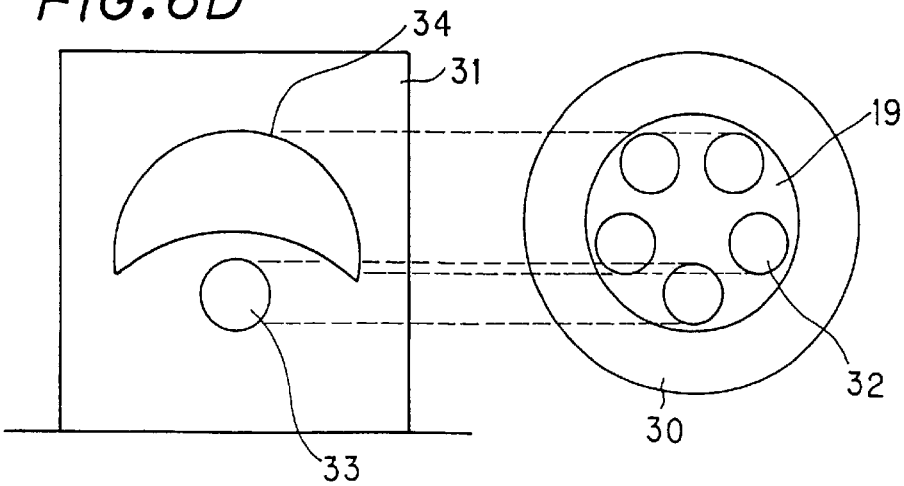

As shown in FIG. 6D, power supply portion 32A may be configured by providing a power supply portion 33 around the nip portion Wn of heat roller 10 and a power supply portion 34 for supplying power to heat generators 15 residing at other than the nip portion Wn. In this case, the power supply arrangement includes a first power supply portion 33 having approximately the same shape and size as electrode 32 of power receiving portion 19 and a second power supply portion 34 which is in contact with other electrodes 32 than that being in contact with first power supply portion 33. The provision of first and second power supply portions 33 and 34 not only enables application of voltage to portion of the heat generator 15 residing near the nip portion Wn but also application to other portions of heat generator 15 through their contacts with electrodes 32.

For example, during the warm-up period in which the temperature of the heat roller is raised from room temperature, the whole heat roller 10 needs to be heated. In this case, electric power is supplied via both first and second power supply portion 33 and 34 so as to heat all portions of the heat generator 15 arranged inside heat roller 10. Then, when a toner image formed on the recording medium is fused thereto after the temperature of heat roller 10 has reached the predetermined level, voltage is applied only to first power supply portion 33 so that portion of the heat generator 15 residing around the nip portion Wn alone can be heated for fusing. In this way, it is possible to efficiently save electric power during fusing by supplying electric power only to portion of the heat generator 15 corresponding to the nip portion Wn.

Figure 7A:
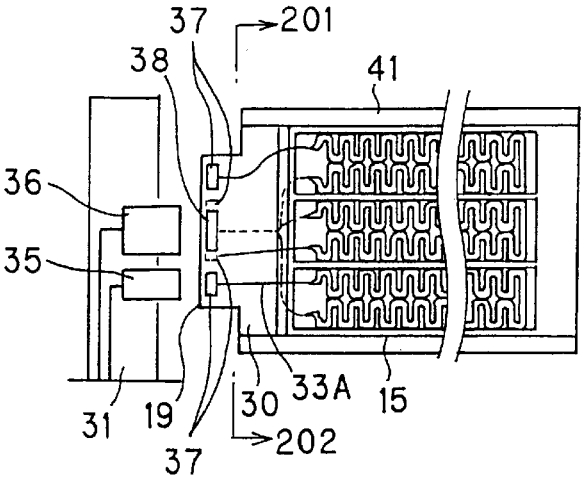
FIG. 7A showing an arrangement of power supply and power receiving portions, FIG. 7B showing a section of the power receiving portion taken along a plane 201–202, FIG. 7C showing a configuration of a power supply portion, FIG. 7D showing another configuration of a power supply portion.

FIG. 7A shows the method of supplying electric power when terminals 17 and 18 of resistance heating elements 14 of heat generator 15 are arranged on one side of heat-resisting insulation member 13. Provided at one end inside metal core 11 is an intermediary member 30 made up of an electric insulator. This intermediary member 30 has a power receiving portion 19. In order to supply electric power to each portion of heat generator 15, this power receiving portion 19 has a multiple number of first electrodes 37 and a second electrode 38, which come into contact with respective first power supply portion 35 and second power supply portion 36 provided for a supporter 31.

As shown in FIG. 7A, resistance heating elements 14 of heat generator 15 fused inside the metal core are connected at one end by lead wires 33A to associated electrodes (first electrodes 37) which are formed on a concentric circle in power receiving portion 19. The other ends are connected by lead wires to second electrode 38 corresponding to the central axis of the power receiving portion.

Figure 7B:
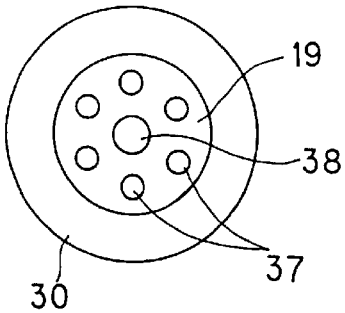

As shown in FIG. 7B, one electrode portion (first electrodes 37) is arranged concentrically with respect to the central axis of heat roller 10 while the other electrode portion (second electrode 38) is arranged at a position corresponding to the central axis of the heat roller.

Figure 7C:
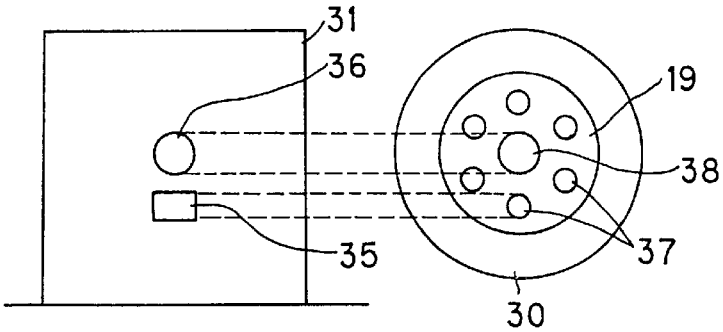

Next, the configuration of the power supply portion will be illustrated. As shown in FIG. 7C, two power supply portions are provided; one (first power supply portion 35) disposed off the central axis of heat roller 10 downwards in the drawing and the other (second power supply portion 36) disposed at a position corresponding to the central axis of power receiving portion 19. Each power supply portion is formed slightly greater in size than the associated electrode formed in power receiving portion 19. Since first electrodes 37 are provided corresponding to the first power supply portion, portion of the heat generator 15 residing around nip Wn of heat roller 10 can be activated as stated above so that it is possible to heat nip Wn and the nearby area to the predetermined temperature.

Similarly to the case shown in FIG. 6D, it is possible to provide an extra power supply portion (not shown) for energizing portions of heat generator 15 located other than the nip portion to thereby heat the entire heat roller 10.

Figure 7D:
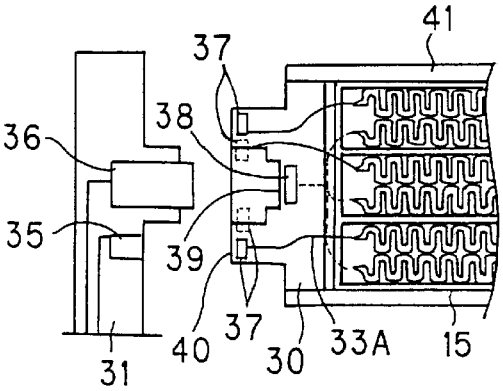

FIG. 7D shows another power supplying method. In this configuration, second power supply portion 36 located at the central axis of heat roller 10 is formed projected while second power receiving portion 39 that moves in sliding contact with the projection is formed depressed in the intermediary member. First power supply portion 35 disposed off the central axis of heat roller 10 downward in the drawing is formed depressed while a first power receiving portion 40 that moves in sliding contact with the first power supply portion is formed projected on a circumference concentric to the central axis. In this way, the power supply portions are formed depressed and projected while the power receiving portions are formed projected and depressed, respectively so that these are mated with each other. This configuration separates first power receiving portion 40 having first electrodes 37 that are arranged on the circumference, from second power receiving portion 39 having a second electrode 38 and hence is effective in preventing short-circuit.

Similarly to the above cases, it is possible to provide an extra power supply portion (not shown) for energizing portions of heat generator 15 located other than the nip portion and thereabout to thereby heat the entire heat roller 10.

In heat generator 15 having resistance heating elements 14 with their terminals arranged on one end, electric power is continuously supplied from second power supply portion 36 positioned at the central axis while only the resistance heating element 14 that passes through the nip portion Wn comes into sliding contact with first power supply portion 35. Resultantly, only the resistance heating element 14 that resides around the nip portion is energized thus making it possible to realize local heating.

The present invention should not be limited to the above embodiments described with the drawings and can of course be modified appropriately without departing from the sprint and scope thereof.

In accordance with the present invention, a multiple number of heat generator portions are arranged in parallel to each other over the entire surface (e.g., over the inner peripheral surface) of a roller-shaped heater. Accordingly, this configuration provides easiness in manufacturing compared to the conventional configuration in which a single sheet of heat generator is arranged over the entire peripheral surface of a roller-shaped heater. In particular, the present invention is effective for a small-diametric roller-shaped heater. Further, if the heat generator is partially damaged, conventionally it has been impossible to partially replace the heat generating sheet inside the roller-shaped heater. However, because the present embodiment uses a multiple number of heat generator portions, this configuration permits the damaged heat generator portion alone to be replaced, becoming more economical. Since the resistance heating elements are arranged in parallel with each other, it is possible to energize the predetermined area alone for heating.

Further, according to the present invention, when a roller-shaped heater has a relatively large diameter, a single heat generator can be set relatively easily. This configuration makes the manufacturing process more simple compared to the case where a multiple number of heat generator portions are set. Further, the arrangement of the resistance heating elements in parallel to each other makes possible local power activation and local heating of the predetermined area.

In accordance with the present invention, the terminals of the resistance heating elements of the heat generator are arranged on one side of the heat-resisting insulation sheet and hence the power supply and receiving portions for electric power supply can be arranged on only one end. Therefore, this arrangement is simple compared to the configuration where the power receiving portions and power supply portions are arranged at both ends.

In accordance with the present invention, since the heat generator is arranged directly on the interior surface of the metal core, it is possible to reduce the warm-up time. Further, power activation of the predetermined area alone for heating makes possible efficient fusing of the unfused toner image onto the recording medium.

In accordance with the present invention, a multiple number of resistance heating elements on the heat-resisting insulation material are aligned in parallel with the axial direction of the heat roller. This configuration makes it possible to selectively heat the resistance heating element around the nip portion alone without energizing all the resistance heating elements disposed inside the heat roller. Thus, this configuration allows more effective use of electric power than the case where the entire roller is heated.

In accordance with the present invention, all the heater elements disposed inside the heat roller can be activated as a whole or only portion of the heat generator residing only around the nip portion Wn can be selectively activated. This configuration enables reduction of the warm-up time and is effective in saving electric energy by activating the heat-generating sheet alone that corresponds to the nip portion Wn.

Finally, according to the present invention, the power supply portion and power receiving portion are coupled with each other by an interfitting arrangement. This configuration is effective in preventing short-circuit between the power supply portion around the nip Wn area and the power supply portion at the center of the axis.

What is claimed is:

1. A roller-shaped heater comprising:

a cylindrically formed roller member; and a heat generator composed of a heat-resisting insulation material and resistance heating elements formed on the heat-resisting insulation material, characterized in that the heat generator is composed of a multiple number of separated portions extending in the axial direction of a cylinder of the roller member, and each portion includes at least one of the resistance heating elements formed on a section of the heat-resisting insulation material, the section being non-integral to sections of the heat-resisting insulation material included in adjacent portions.

2. The roller-shaped heater according to claim 1, wherein power receiving portions that receive electric power for the resistance heating elements formed in the heat generator are formed at one end of the heat generator.

3. A roller-shaped heater comprising:

a cylindrically formed roller member; and a heat generator composed of a heat-resisting insulation material and resistance heating elements formed on the heat-resisting insulation material, characterized in that the heat generator is formed with a multiple number of resistance heating elements and the multiple number of resistance heating elements are arranged in parallel with each other in the axial direction of a cylinder of the roller member, and wherein the heat-resisting insulation material comprises a plurality of discrete sections each having at least one of the resistance heating elements formed thereon.

4. The roller-shaped heater according to claim 3, wherein power receiving portions that receive electric power for the resistance heating elements formed in the heat generator are formed at one end of the heat generator.

5. A fusing unit comprising:

a roller-shaped heater comprising: a cylindrically formed roller member; and a heat generator composed of a heat-resisting insulation material and resistance heating elements formed on the heat-resisting insulation material wherein the heat generator is composed of a multiple number of separated portions extending in the axial direction of a cylinder of the roller member, and each portion includes at least one of the resistance heating elements formed on a section of the heat-resisting insulation material, the section being non-integral to sections of the heat-resisting insulation material included in adjacent portions; and a pressing member is disposed abutting against the roller-shaped heater, characterized in that fusing is performed by conveying a recording medium having an unfused toner image supported thereon through a nip between the roller-shaped heater and the pressing member.

6. The fusing unit according to claim 5, wherein the roller-shaped heater has a power receiving portion at one end of the heat generator through which electric current is supplied to the resistance heating elements formed in the heat generator and the pressing member is disposed abutting against the roller-shaped heater, so that fusing is performed by conveying a recording medium having an unfused toner image supported thereon through the nip between the roller-shaped heater and the pressing member.

7. A fusing unit comprising:

a roller-shaped heater comprising: a cylindrically formed roller member; and a heat generator composed of a heat-resisting insulation material and resistance heating elements formed on the heat-resisting insulation material wherein the heat generator is provided with a multiple number of resistance heating elements extending in parallel with each other in the axial direction of a cylinder of the roller member, wherein the heat-resisting insulation material comprises a plurality of discrete sections each having at least one of the resistance heating elements formed thereon; and a pressing member disposed abutting against the roller-shaped heater, characterized in that fusing is performed by conveying a recording medium having an unfused toner image supported thereon through a nip between the roller-shaped heater and the pressing member.

8. The fusing unit according to claim 7, wherein the roller-shaped heater has a power receiving portion at one end of the heat generator through which electric current is supplied to the resistance heating elements formed in the heat generator and the pressing member is disposed abutting against the roller-shaped heater, so that fusing is performed by conveying a recording medium having an unfused toner image supported thereon through the nip between the roller-shaped heater and the pressing member.

9. A fusing unit comprising:

a roller-shaped heater comprising: a cylindrically formed roller member; and a heat generator composed of a heat-resisting insulation material and resistance heating elements formed on the heat-resisting insulation material wherein the heat generator is composed of a multiple number of separated portions extending in the axial direction of a cylinder of the roller member and each portion has the resistance heating element; and a pressing member is disposed abutting against the roller-shaped heater, characterized in that fusing is performed by conveying a recording medium having an unfused toner image supported thereon through a nip between the roller-shaped heater and the pressing member, wherein electric power is selectively supplied to one of the resistance heating elements in the heat generator which corresponds to the nip area formed between the roller-shaped heater and the pressing member.

10. The fusing unit according to claim 9, further comprising: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

11. A fusing unit comprising:

a roller-shaped heater comprising: a cylindrically formed roller member; and a heat generator composed of a heat-resisting insulation material and resistance heating elements formed on the heat-resisting insulation material wherein the heat generator is provided with a multiple number of resistance heating elements extending in parallel with each other in the axial direction of a cylinder of the roller member; and a pressing member disposed abutting against the roller-shaped heater, characterized in that fusing is performed by conveying a recording medium having an unfused toner image supported thereon through a nip between the roller-shaped heater and the pressing member, and wherein electric power is selectively supplied to one of the resistance heating elements in the heat generator which corresponds to the nip area formed between the roller-shaped heater and the pressing member.

12. The fusing unit according to claim 11, further comprising: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

13. A fusing unit comprising:

a roller-shaped heater comprising: a cylindrically formed roller member; and a heat generator composed of a heat-resisting insulation material and resistance heating elements formed on the heat-resisting insulation material wherein the heat generator is composed of a multiple number of separated portions extending in the axial direction of a cylinder of the roller member and each portion has the resistance heating element; and a pressing member is disposed abutting against the roller-shaped heater, characterized in that fusing is performed by conveying a recording medium having an unfused toner image supported thereon through a nip between the roller-shaped heater and the pressing member, wherein the roller-shaped heater has a power receiving portion at one end of the heat generator through which electric current is supplied to the resistance heating elements formed in the heat generator and the pressing member is disposed abutting against the roller-shaped heater, so that fusing is performed by conveying a recording medium having an unfused toner image supported thereon through the nip between the roller-shaped heater and the pressing member, and wherein electric power is selectively supplied to one of the resistance heating elements in the heat generator which corresponds to the nip area formed between the roller-shaped heater and the pressing member.

14. The fusing unit according to claim 13, further comprising: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

15. A fusing unit comprising:

a roller-shaped heater comprising: a cylindrically formed roller member; and a heat generator composed of a heat-resisting insulation material and resistance heating elements formed on the heat-resisting insulation material wherein the heat generator is provided with a multiple number of resistance heating elements extending in parallel with each other in the axial direction of a cylinder of the roller member; and a pressing member disposed abutting against the roller-shaped heater, characterized in that fusing is performed by conveying a recording medium having an unfused toner image supported thereon through a nip between the roller-shaped heater and the pressing member, wherein the roller-shaped heater has a power receiving portion at one end of the heat generator through which electric current is supplied to the resistance heating elements formed in the heat generator and the pressing member is disposed abutting against the roller-shaped heater, so that fusing is performed by conveying a recording medium having an unfused toner image supported thereon through the nip between the roller-shaped heater and the pressing member, and wherein electric power is selectively supplied to one of the resistance heating elements in the heat generator which corresponds to the nip area formed between the roller-shaped heater and the pressing member.

16. The fusing unit according to claim 15, further comprising: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

17. A fusing unit comprising:

a roller-shaped heater comprising: a cylindrically formed roller member; and a heat generator composed of a heat-resisting insulation material and resistance heating elements formed on the heat-resisting insulation material wherein the heat generator is composed of a multiple number of separated portions extending in the axial direction of a cylinder of the roller member and each portion has the resistance heating element; and a pressing member is disposed abutting against the roller-shaped heater, characterized in that fusing is performed by conveying a recording medium having an unfused toner image supported thereon through a nip between the roller-shaped heater and the pressing member, and wherein electric power can be supplied to all the resistance heating elements in the heat generator so that the entire roller-shaped heater is heated and also electric power can be selectively supplied to one of the resistance heating elements in the heat generator which corresponds to the nip area formed between the roller-shaped heater and the pressing member.

18. The fusing unit according to claim 17, further comprising: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

19. A fusing unit comprising:

a roller-shaped heater comprising: a cylindrically formed roller member; and a heat generator composed of a heat-resisting insulation material and resistance heating elements formed on the heat-resisting insulation material wherein the heat generator is provided with a multiple number of resistance heating elements extending in parallel with each other in the axial direction of a cylinder of the roller member; and a pressing member disposed abutting against the roller-shaped heater, characterized in that fusing is performed by conveying a recording medium having an unfused toner image supported thereon through a nip between the roller-shaped heater and the pressing member, and wherein electric power can be supplied to all the resistance heating elements in the heat generator so that the entire roller-shaped heater is heated and also electric power can be selectively supplied to one of the resistance heating elements in the heat generator which corresponds to the nip area formed between the roller-shaped heater and the pressing member.

20. The fusing unit according to claim 19, further comprising: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

21. A fusing unit comprising:

a roller-shaped heater comprising: a cylindrically formed roller member; and a heat generator composed of a heat-resisting insulation material and resistance heating elements formed on the heat-resisting insulation material wherein the heat generator is composed of a multiple number of separated portions extending in the axial direction of a cylinder of the roller member and each portion has the resistance heating element; and a pressing member is disposed abutting against the roller-shaped heater, characterized in that fusing is performed by conveying a recording medium having an unfused toner image supported thereon through a nip between the roller-shaped heater and the pressing member, wherein the roller-shaped heater has a power receiving portion at one end of the heat generator through which electric current is supplied to the resistance heating elements formed in the heat generator and the pressing member is disposed abutting against the roller-shaped heater, so that fusing is performed by conveying a recording medium having an unfused toner image supported thereon through the nip between the roller-shaped heater and the pressing member, and wherein electric power can be supplied to all the resistance heating elements in the heat generator so that the entire roller-shaped heater is heated and also electric power can be selectively supplied to one of the resistance heating elements in the heat generator which corresponds to the nip area formed between the roller-shaped heater and the pressing member.

22. The fusing unit according to claim 21, further comprising: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

23. A fusing unit comprising:

a roller-shaped heater comprising: a cylindrically formed roller member; and a heat generator composed of a heat-resisting insulation material and resistance heating elements formed on the heat-resisting insulation material wherein the heat generator is provided with a multiple number of resistance heating elements extending in parallel with each other in the axial direction of a cylinder of the roller member; and pressing member disposed abutting against the roller-shaped heater, characterized in that fusing is performed by conveying a recording medium having an unfused toner image supported thereon through a nip between the roller-shaped heater and the pressing member, wherein the roller-shaped heater has a power receiving portion at one end of the heat generator through which electric current is supplied to the resistance heating elements formed in the heat generator and the pressing member is disposed abutting against the roller-shaped heater, so that fusing is performed by conveying a recording medium having an unfused toner image supported thereon through the nip between the roller-shaped heater and the pressing member, and wherein electric power can be supplied to all the resistance heating elements in the heat generator so that the entire roller-shaped heater is heated and also electric power can be selectively supplied to one of the resistance heating elements in the heat generator which corresponds to the nip area formed between the roller-shaped heater and the pressing member.

24. The fusing unit according to claim 23, further comprising: a power supply portion for supplying electric power to the heat generator; a power receiving portion which receives electric power from the power supply portion to supply the resistance heating elements formed in the heat generator, wherein the power supply portion and the power receiving portion are mated to each other in an interfitting manner.

* * * * *